US005819973A

United States Patent [19]

Traub, Sr. et al.

[11] Patent Number: 5,819,973

[45] Date of Patent: Oct. 13, 1998

[54] BEVERAGE CONTAINER LID HAVING A LIFT TAB FOR OPENING AN APERTURE AND VENT HOLE

[76] Inventors: John J. Traub, Sr., 173 Meadowbrook La.; Michael Cziraky, 175 Meadowbrook La., both of Brookhaven, Pa. 19015

[21] Appl. No.: 775,731

[22] Filed: Dec. 31, 1996

[51] Int. Cl.[6] ..... B65D 17/34

[52] U.S. Cl. ..... 220/271; 220/269; 220/270; 220/906

[58] Field of Search ..... 220/269, 270, 220/271, 272, 265, 266, 906

[56] References Cited

U.S. PATENT DOCUMENTS

| | | | |
|---|---|---|---|
| 3,283,946 | 11/1966 | Stec | 220/271 X |
| 3,326,406 | 6/1967 | Brown | 220/269 |
| 3,441,167 | 4/1969 | Balocla | 220/271 |
| 3,485,410 | 12/1969 | Boik | 220/271 |
| 3,951,299 | 4/1976 | Khoury | 220/271 X |
| 4,002,262 | 1/1977 | Khoury | 220/271 |
| 4,014,455 | 3/1977 | LaCroce | 220/271 X |
| 4,148,410 | 4/1979 | Brown | 220/269 |
| 4,205,760 | 6/1980 | Hasegawa | 220/271 |
| 4,386,713 | 6/1983 | Baumeyer et al. | 220/269 |
| 5,011,037 | 4/1991 | Moen et al. | 220/271 |
| 5,065,882 | 11/1991 | Sugiyama | 220/269 |
| 5,285,919 | 2/1994 | Recchia | 220/271 |
| 5,494,184 | 2/1996 | Noguchi et al. | 220/271 X |

*Primary Examiner*—Stephen Cronin
*Assistant Examiner*—Robin A. Hylton

[57] ABSTRACT

A new beverage container lid having a lift tab for opening an aperture and vent hole for easily opening the container and providing an air vent which opens by a force applied to open the sealed opening. The inventive device includes a lid member having a severable sealed opening and a severable sealed vent hole disposed thereon, a lift tab pivotally mounted upon the lid member, the lift tab having a handle end and an abutment end for contacting and exerting a downward force upon the severable sealed opening to form an opening upon the exertion of an upward force upon the handle end, and a vent hole rivet hingedly attached to the lift tab and attached to the severable sealed vent hole to form a vent hole upon the exertion of the upward force.

17 Claims, 2 Drawing Sheets

BEVERAGE CONTAINER LID HAVING A LIFT TAB FOR OPENING AN APERTURE AND VENT HOLE

BACKGROUND OF THE INVENTION

1. Field of the Invention

The present invention relates to beverage containers having a sealed opening and more particularly pertains to a new beverage container lid having a lift tab for opening an aperture and vent hole for easily opening the sealed opening and providing an air vent which opens by a force applied to open the sealed opening.

2. Description of the Prior Art

The use of beverage containers having a sealed opening is known in the prior art. More specifically, beverage containers having a sealed opening heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage containers having a sealed opening include U.S. Pat. No. 5,011,037; U.S. Pat. No. 4,872,597; U.S. Pat. No. Des. 347,973; U.S. Pat. No. 5,397,014; U.S. Pat. No. 4,252,247 and U.S. Pat. No. 4,213,538.

While these devices fulfill their respective, particular objectives and requirements, the aforementioned patents do not disclose a new beverage container lid having a lift tab for opening an aperture and vent hole. The inventive device includes a lid member having a severable sealed opening and a severable sealed vent hole disposed thereon, a means for pivotally mounting a lift tab upon the lid member, the lift tab having a handle end and an abutment end for contacting and exerting a downward force upon the severable sealed opening to form an opening upon the exertion of an upward force upon the handle end, and a means for severing the severable sealed vent hole to form a vent hole.

In these respects, the beverage container lid having a lift tab for opening an aperture and vent hole according to the present invention substantially departs from the conventional concepts and designs of the prior art, and in so doing provides an apparatus primarily developed for the purpose of easily opening the sealed opening and providing an air vent which opens by a force applied to open the sealed opening.

SUMMARY OF THE INVENTION

In view of the foregoing disadvantages inherent in the known types of beverage containers having a sealed opening now present in the prior art, the present invention provides a new beverage container lid having a lift tab for opening an aperture and vent hole construction wherein the same can be utilized for easily opening the sealed opening and providing an air vent which opens by a force applied to open the sealed opening.

The general purpose of the present invention, which will be described subsequently in greater detail, is to provide a new beverage container lid having a lift tab for opening an aperture and vent hole apparatus and method which has many of the advantages of the beverage containers having a sealed opening mentioned heretofore and many novel features that result in a new beverage container lid having a lift tab for opening an aperture and vent hole which is not anticipated, rendered obvious, suggested, or even implied by any of the prior art beverage containers having a sealed opening, either alone or in any combination thereof.

To attain this, the present invention generally comprises a lid member having a severable sealed opening and a severable sealed vent hole disposed thereon, a means for pivotally mounting a lift tab upon the lid member, the lift tab having a handle end and an abutment end for contacting and exerting a downward force upon the severable sealed opening to form an opening upon the exertion of an upward force upon the handle end, and a means for severing the severable sealed vent hole to form a vent hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also. it is to be understood that the phraseology and terminology employed herein are for the purpose of description and should not be regarded as limiting.

As such. those skilled in the art will appreciate that the conception. upon which this disclosure is based, may readily be utilized as a basis for the designing of other structures, methods and systems for carrying out the several purposes of the present invention. It is important therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage container lid having a lift tab for opening an aperture and vent hole apparatus and method which has many of the advantages of the beverage containers having a sealed opening mentioned heretofore and many novel features that result in a new beverage container lid having a lift tab for opening an aperture and vent hole which is not anticipated, rendered obvious, suggested, or even implied by any of the prior art beverage containers having a sealed opening, either alone or in any combination thereof.

It is another object of the present invention to provide a new beverage container lid having a lift tab for opening an aperture and vent hole which may be easily and efficiently manufactured and marketed.

It is a further object of the present invention to provide a new beverage container lid having a lift tab for opening an aperture and vent hole which is of a durable and reliable construction.

An even further object of the present invention is to provide a new beverage container lid having a lift tab for opening an aperture and vent hole which is susceptible of a low cost of manufacture with regard to both materials and labor, and which accordingly is then susceptible of low prices of sale to the consuming public, thereby making such beverage container lid having a lift tab for opening an aperture and vent hole economically available to the buying public.

Still yet another object of the present invention is to provide a new beverage container lid having a lift tab for opening an aperture and vent hole which provides in the apparatuses and methods of the prior art some of the advantages thereof, while simultaneously overcoming some of the disadvantages normally associated therewith.

Still another object of the present invention is to provide a new beverage container lid having a lift tab for opening an aperture and vent hole for easily opening the sealed opening and providing an air vent which opens by a force applied to open the sealed opening.

Yet another object of the present invention is to provide a new beverage container lid having a lift tab for opening an aperture and vent hole which includes a lid member having a severable sealed opening and a severable sealed vent hole disposed thereon, a means for pivotally mounting a lift tab upon the lid member, the lift tab having a handle end and an abutment end for contacting and exerting a downward force upon the severable sealed opening to form an opening upon the exertion of an upward force upon the handle end, and a means for severing the severable sealed vent hole to form a vent hole.

Still yet another object of the present invention is to provide a new beverage container lid having a lift tab for opening an aperture and vent hole that improves the flow of the beverage container contents when poured.

Even still another object of the present invention is to provide a new beverage container lid having a lift tab for opening an aperture and vent hole that eliminates the broken fingernails resulting from the opening of prior art flip tops.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
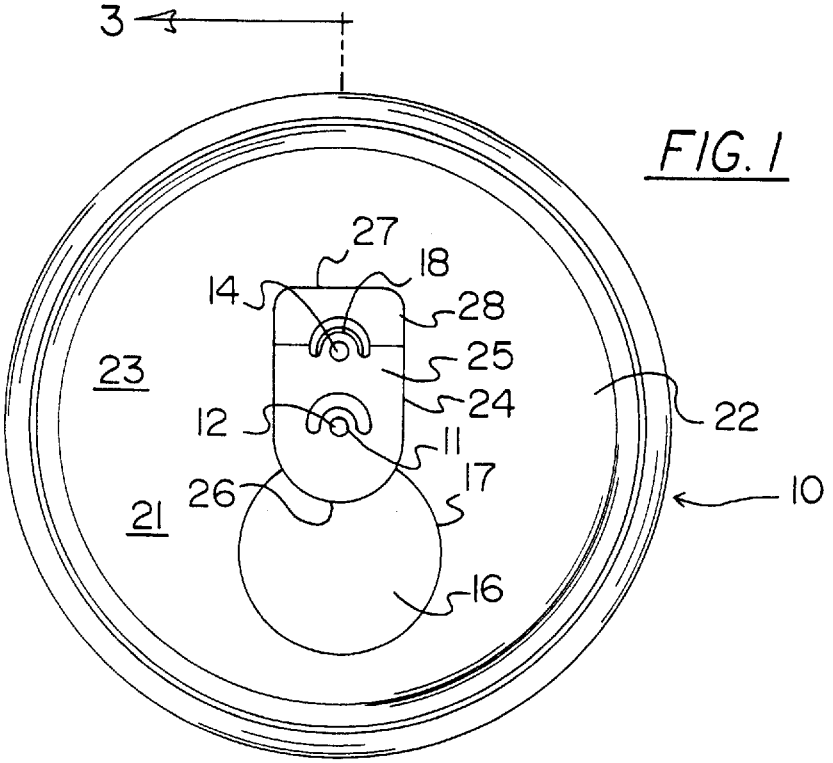
FIG. 1 is a top plan view of a new beverage container lid having a lift tab for opening an aperture and vent hole according to the present invention.

With reference now to the drawings, and in particular to FIGS. 1 through 4 thereof, a new beverage container lid having a lift tab for opening an aperture and vent hole embodying the principles and concepts of the present invention and generally designated by the reference numeral 10 will be described.

More specifically, it will be noted that the beverage container lid having a lift tab for opening an aperture and vent hole 10 comprises a lid member 22 having a severable sealed opening 16 and a severable sealed vent hole 19 disposed thereon, a means for pivotally mounting a lift tab 25 upon a lid member upper surface 23, the lift tab 25 having an abutment end 26 and a handle end 27, the abutment end 26 being pivotable about the means for pivotally mounting the lift tab 25 upon the lid member upper surface 23 upon the exertion of an upward force upon the handle end 27 directed axially away from the lid member upper surface 23, the abutment end 26 contacting and exerting a downward force upon the severable sealed opening 16 upon the exertion of the upward force upon the handle end 27, the downward force severing the severable sealed opening 16 to form an opening 30, and a means for severing the severable sealed vent 19 to form a vent hole 13 upon the exertion of the upward force.

With reference to FIG. 1, the lid member 22 is shown including the severable sealed opening 16 defined by the opening score line 17 and lid member upper surface 23. The lift tab 25 is shown including the abutment end 26 and the handle end 27. A vent hole hinge tab 18 and a pivot hinge tab 11 are integrally formed on a flat portion 24 of the lift tab 25 by means of crescent shaped cuts adjacent the vent hole hinge tab 18 and the pivot hinge tab 11. The flat portion 24 is shown disposed in a plane substantially parallel to a plane formed by the lid member upper surface 23.

Figure 2:
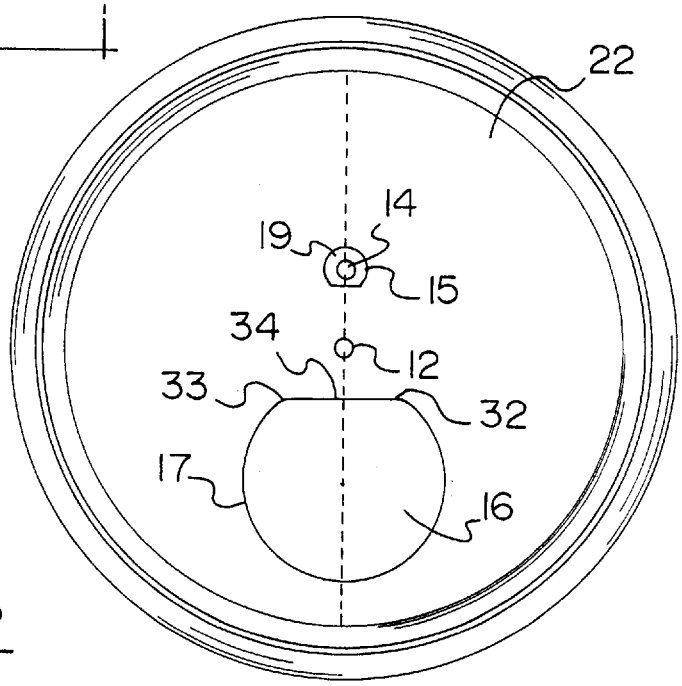
FIG. 2 is a top plan view of the present invention with the lift tab removed.

FIG. 2 shows a rivet 12 fixedly and sealingly attached to the lid member 22. Also shown is a vent hole rivet 14 fixedly and sealingly attached to the severable sealed vent hole 19 defined by a vent hole score line 15. Also shown is a hinge portion 34 having spaced apart ends connected to a first end 32 and a second end 33 of the opening score line 17. A diametrical line extends across the lid member 22 and passes through the severable sealed opening 16, the rivet 12 and the severable sealed vent hole 19.

Figure 3:
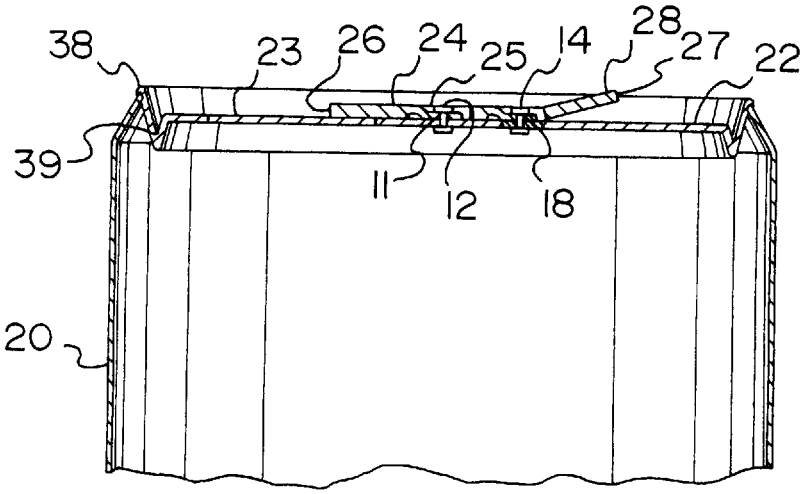
FIG. 3 is cross sectional view taken along line 3—3 of FIG. 3.

With reference to FIG. 3, the lift tab 25 is shown including an upwardly extending portion 28 having a handle end 27. The upwardly extending portion 28 is disposed in a plane whose intersection with the plane formed by the lid member upper surface 23 forms an acute angle. The lid member 22 also includes an annular rim 38 connectable to a beverage container 20. A recessed portion 39 adjoins the annular rim 38 to a central portion 21 of the lid member 22.

Figure 4:
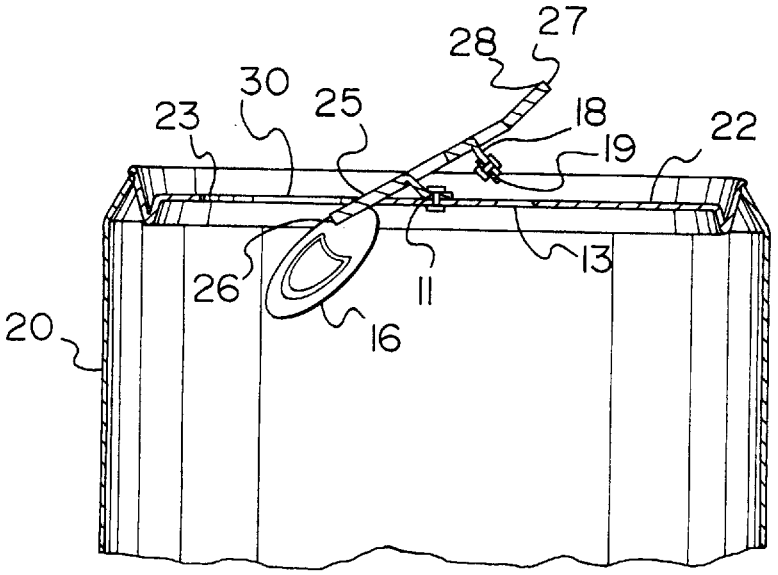
FIG. 4 is a cross sectional view of the present invention showing the pivoting movement of the lift tab upon the exertion of an upward force upon handle end of the lift tab.

With reference to FIG. 4 an upward force is exerted upon the handle end 27 directed axially away from the lid member upper surface 23. The upward force causes the lift tab 25 to pivot about the rivet 12, the abutment end 26 contacts and exerts a downward force upon the severable scaled opening 16 severing the severable scaled opening to form an opening 30, the severable sealed opening 16 pivoting about the hinge portion 34. The upward force also exerts a substantially upward severing force upon the vent hole rivet 14 which severs the severable sealed vent hole 19 to form a vent hole 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage container lid for use with a beverage can, the beverage container lid comprising:

a lid member having a severable sealed opening and a severable sealed vent hole disposed thereon;

a mounting means for pivotally mounting a lift tab on an upper surface of the lid member, the lift tab further comprising an abutment end and a handle end, the abutment end being pivotable about the mounting means when an upward force acts on the handle end the upward force being directed axially away from the lid member upper surface, whereby the abutment end exerts a downward force on the severable sealed opening thereby severing the severable sealed opening to form an opening;

a vent hole seal severing means for severing the severable sealed vent hole to form a vent hole upon the exertion of the upward force; and wherein the vent hole severing means further comprises a vent hole rivet hingedly attached to the lift tab, the vent hole rivet being fixedly and sealingly attached to the severable sealed vent hole and extending through a vent hole hinge tab integrally formed on the lift tab.

2. The beverage container lid of claim 1, wherein the severable sealed opening is defined by an opening score line.

3. The beverage container lid of claim 1, wherein the severable sealed vent hole is defined by a vent hole score line.

4. The beverage container lid of claim 1, wherein the lift tab includes:

a flat portion, the flat portion being positioned proximate the sealed opening and disposed in a plane substantially parallel to a plane formed by the lid member upper surface; and an upwardly extending portion disposed upwardly from a flat portion edge such that the upwardly extending portion is positioned opposite the sealed opening and in a plane whose intersection with the plane formed by the lid member upper surface forms an acute angle.

5. The beverage container lid of claim 1, wherein the mounting means further comprises a rivet hingedly attached to the lift tab, the rivet being fixedly and sealingly attached to the lid member and extending through a pivot hinge tab integrally formed on the lift tab.

6. The beverage container lid of claim 1, wherein the severable sealed opening is defined by an opening score line having first and second ends, the first and second ends being disposed adjacent spaced apart ends of a hinge portion, the hinge portion being integrally formed on the lid member, the downward force severing the severable sealed opening, the severable sealed opening pivoting about the hinge portion.

7. The beverage container lid of claim 1, wherein the lid member further comprises an annular rim, said annular rim being adapted to couple to the beverage container.

8. The beverage container lid of claim 7, wherein the lid member further comprises a central portion and a recessed portion extending therearound, the recessed portion adjoining the annular rim and the central portion.

9. A beverage container lid for use with a beverage can, the beverage container lid comprising:

a lid member having a severable sealed opening and a severable sealed vent hole disposed thereon said severable sealed opening defined by an opening score line having first and second ends, the first and second ends being disposed adjacent spaced apart ends of a hinge portion, the hinge portion being integrally formed on the lid member;

a mounting means for pivotally mounting a lift tab on an upper surface of the lid member, the lift tab further comprising an abutment end and a handle end, the abutment end being pivotable about the mounting means when an upward force acts on the handle end the upward force being directed axially away from the lid member upper surface, whereby the abutment end exerts a downward force on the severable sealed opening thereby severing the severable sealed opening to form an opening;

a vent hole seal severing means for severing the severable sealed vent hole to form a vent hole upon the exertion of the upward force; and a diametrical line extending across the lid member and passing through the severable sealed opening, the means for pivotally mounting the lift tab upon the lid member upper surface and the severable sealed vent hole, the means for pivotally mounting the lift tab upon the lid member upper surface being disposed between the severable sealed opening and the severable sealed vent hole.

10. The beverage container lid of claim 9, wherein the severable sealed opening is defined by an opening score line.

11. The beverage container lid of claim 9, wherein the severable sealed vent hole is defined by a vent hole score line.

12. The beverage container lid of claim 9, wherein the lift tab includes:

a flat portion, the flat portion being positioned proximate the sealed opening and disposed in a plane substantially parallel to a plane formed by the lid member upper surface; and an upwardly extending portion disposed upwardly from a flat portion edge such that the upwardly extending portion is positioned opposite the sealed opening and in a plane whose intersection with the plane formed by the lid member upper surface forms an acute angle.

13. The beverage container lid of claim 9, wherein the mounting means further comprises a rivet hingedly attached to the lift tab, the rivet being fixedly and sealingly attached to the lid member and extending through a pivot hinge tab integrally formed on the lift tab.

14. The beverage container lid of claim 9, wherein the severable sealed opening is defined by an opening score line having first and second ends, the first and second ends being disposed adjacent spaced apart ends of a hinge portion, the hinge portion being integrally formed on the lid member, the downward force severing the severable sealed opening, the severable sealed opening pivoting about the hinge portion.

15. The beverage container lid of claim 9, wherein the lid member further comprises an annular rim, said annular rim being adapted to couple to the beverage container.

16. The beverage container lid of claim 15, wherein the lid member further comprises a central portion and a recessed portion extending therearound, the recessed portion adjoining the annular rim and the central portion.

17. A beverage container lid for use with a beverage can, the beverage container lid comprising:

a lid member having a lid member upper surface, a severable sealed opening defined by an opening score line having first and second ends, the first and second ends being disposed adjacent spaced apart ends of a hinge portion, the hinge portion being integrally formed on the lid member, a severable sealed vent hole defined by a vent hole score line, an annular rim connectable to the beverage container, a central portion, and a recessed portion extending around the central portion, the recessed portion adjoining the annular rim and the central portion;

a lift tab pivotally mounted upon the lid member upper surface by means of a rivet hingedly attached to the lift tab, the rivet being fixedly and sealingly attached to the lid member and extending through a pivot hinge tab integrally formed on the lift tab, the lift tab further comprising a flat portion, the flat portion having an abutment end and being disposed in a plane substantially parallel to a plane formed by the lid member upper surface, and an upwardly extending portion forming a handle end, the upwardly extending portion being disposed in a plane whose intersection with the plane formed by the upper surface forms an acute angle, an upward force exerted upon the handle end in a direction axially away from the lid member upper surface causing the abutment end to contact and exert a downward force upon the severable sealed opening, the downward force severing the severable sealed opening to form an opening, the severable sealed opening pivoting about the hinge portion;

a vent hole rivet hingedly attached to the lift tab, the vent hole rivet being fixedly and sealingly attached to the severable sealed vent hole and extending through a vent hole hinge tab integrally formed on the lift tab, the upward force exerted upon the handle end exerting a substantially upward severing force to be applied to the vent hole rivet, the substantially upward severing force severing the severable sealed vent hole to form a vent hole; and a diametrical line extending across the lid member and passing through the severable sealed opening, the rivet and the severable sealed vent hole, the rivet being disposed between the severable sealed opening and the severable sealed vent hole.

* * * * *